US011039644B2

(12) United States Patent
Paprocki et al.

(10) Patent No.: US 11,039,644 B2
(45) Date of Patent: Jun. 22, 2021

(54) APPARATUS FOR HEATING SMOKEABLE MATERIAL

(71) Applicant: BRITISH AMERICAN TOBACCO (INVESTMENTS) LIMITED, London (GB)

(72) Inventors: Benjamin John Paprocki, Cottage Grove, WI (US); Andrew Paul Wilke, Madison, WI (US); Raymond John Robey, Madison, WI (US); Jesse Eugene Robinson, Janesville, WI (US); Feng Tian, Monona, WI (US)

(73) Assignee: Nicoventures Trading Limited, London (GB)

( * ) Notice: Subject to any disclaimer, the term of this patent is extended or adjusted under 35 U.S.C. 154(b) by 452 days.

(21) Appl. No.: 15/028,936

(22) PCT Filed: Oct. 24, 2014

(86) PCT No.: PCT/EP2014/072828
§ 371 (c)(1),
(2) Date: Apr. 12, 2016

(87) PCT Pub. No.: WO2015/062983
PCT Pub. Date: May 7, 2015

(65) Prior Publication Data

US 2016/0255879 A1 Sep. 8, 2016

Related U.S. Application Data

(60) Provisional application No. 61/897,193, filed on Oct. 29, 2013.

(51) Int. Cl.
*A24F 47/00* (2020.01)
*H05B 1/02* (2006.01)

(52) U.S. Cl.
CPC ..... *A24F 47/008* (2013.01); *H05B 1/0291* (2013.01)

(58) Field of Classification Search
CPC ..... A24F 47/008; H05B 1/0291; A61L 9/03; A61L 9/037; F02M 31/12
(Continued)

(56) References Cited

U.S. PATENT DOCUMENTS 844,272 A 2/1907 Fate
912,986 A 2/1909 Aschenbrenner
(Continued)

FOREIGN PATENT DOCUMENTS

CN 86102917 11/1987
CN 1040914 4/1990
(Continued)

OTHER PUBLICATIONS

PCT International Search Report for PCT/EP2014/072828, dated Jun. 16, 2015, 4 pages.
(Continued)

*Primary Examiner* — Phuong T Nguyen
(74) *Attorney, Agent, or Firm* — Patterson Thuente Pedersen, P.A.

(57) ABSTRACT

An apparatus is arranged to heat smokable material (5) to volatilize at least one component of the smokable material. In one exemplary embodiment, the apparatus has a housing and a plurality of heater segments longitudinally arranged within the housing for heating smokable material contained within the apparatus. At least one heater segment is arranged so as to heat smokable material contained within the at least one heater segment more quickly than at least one other heater segment heats smokable material contained within the at least one other heater segment.

20 Claims, 6 Drawing Sheets

(58) Field of Classification Search
USPC ..... 392/386–387, 390–398; 131/329
See application file for complete search history.

(56) References Cited

U.S. PATENT DOCUMENTS 1,071,817 A 9/1913 Stanley
1,771,366 A 7/1930 Wyss et al.
1,886,391 A 11/1932 Gauvin
2,104,266 A 1/1938 McCormick
3,225,954 A 12/1965 Herrick et al.
3,265,236 A 8/1966 Gibbon
3,804,100 A 4/1974 Fariello
3,805,806 A 4/1974 Grihalva
3,889,690 A 6/1975 Guarnieri
4,171,000 A 10/1979 Uhle
4,303,083 A 12/1981 Burruss, Jr.
4,474,191 A 10/1984 Steiner
4,588,976 A 5/1986 Jaselli
4,628,187 A 12/1986 Sekiguchi
4,638,820 A 1/1987 Roberts et al.
4,675,508 A 6/1987 Miyaji
4,735,217 A 4/1988 Gerth et al.
4,756,318 A 7/1988 Clearman et al.
4,765,347 A 8/1988 Sensabaugh et al.
4,907,606 A 3/1990 Lilja et al.
4,922,901 A 5/1990 Brooks et al.
4,945,929 A 8/1990 Egilmex
4,945,931 A 8/1990 Gori
4,947,874 A 8/1990 Brooks et al.
4,947,875 A 8/1990 Brooks et al.
5,040,551 A 8/1991 Schlatter et al.
5,060,671 A 10/1991 Counts et al.
5,093,894 A 3/1992 Deevi
5,095,921 A 3/1992 Losee et al.
5,144,962 A 9/1992 Counts
5,179,966 A 1/1993 Losee et al.
5,190,060 A 3/1993 Gerding et al.
5,203,355 A 4/1993 Clearman
5,224,498 A 7/1993 Deevi et al.
5,247,947 A 9/1993 Clearman et al.
5,249,586 A 10/1993 Morgan et al.
5,251,688 A 10/1993 Schatz
5,261,424 A 11/1993 Sprinkel
5,269,327 A 12/1993 Counts et al.
5,271,980 A 12/1993 Bell
5,285,798 A 2/1994 Banerjee et al.
5,303,720 A 4/1994 Banerjee et al.
5,322,075 A 6/1994 Deevi et al.
5,327,915 A 7/1994 Porenski et al.
5,331,979 A 7/1994 Henley
5,345,951 A 9/1994 Serrano et al.
5,353,813 A 10/1994 Deevi et al.
5,369,723 A 11/1994 Counts et al.
5,372,148 A 12/1994 McCafferty
5,388,594 A 2/1995 Counts et al.
5,402,803 A 4/1995 Takagi
5,408,574 A 4/1995 Deevi et al.
5,468,936 A 11/1995 Deevi
5,505,214 A 4/1996 Collins et al.
5,573,140 A 11/1996 Satomi et al.
5,613,504 A 3/1997 Collins et al.
5,613,505 A 3/1997 Campbell et al.
5,665,262 A 9/1997 Hajaligol et al.
5,771,845 A 6/1998 Pistien et al.
5,798,154 A 8/1998 Bryan
5,865,186 A 2/1999 Volsey, II
6,026,820 A 2/2000 Baggett et al.
6,037,568 A * 3/2000 Hatanaka ..... F23Q 7/001 219/260
6,040,560 A 3/2000 Fleischhauer
6,089,857 A 7/2000 Matsuura et al.
6,125,853 A 10/2000 Susa
6,155,268 A 12/2000 Takeuchi
6,315,366 B1 11/2001 Post
6,376,816 B2 4/2002 Cooper
6,868,230 B2 3/2005 Gerhardinger
6,994,096 B2 2/2006 Rostami
7,374,063 B2 5/2008 Reid
7,624,739 B2 12/2009 Snaidr et al.
7,913,688 B2 3/2011 Cross et al.
8,061,361 B2 11/2011 Maeder et al.
8,079,371 B2 12/2011 Robinson et al.
8,081,474 B1 12/2011 Zohni
8,678,013 B2 3/2014 Crooks et al.
8,757,404 B1 * 6/2014 Fleckenstein ..... A47J 41/0005 206/217
8,807,140 B1 8/2014 Scatterday
8,833,364 B2 9/2014 Buchberger
9,357,803 B2 6/2016 Egoyants et al.
9,414,629 B2 8/2016 Egoyants et al.
9,554,598 B2 1/2017 Egoyants et al.
9,609,894 B2 4/2017 Abramov et al.
2002/0005207 A1 1/2002 Wrenn
2002/0079309 A1 6/2002 Cox
2003/0049025 A1 3/2003 Neumann et al.
2003/0146224 A1 8/2003 Fuji
2004/0003820 A1 1/2004 Iannuzzi
2004/0096204 A1 5/2004 Gerhardinger
2004/0149297 A1 8/2004 Sharpe
2004/0149737 A1 8/2004 Sharpe
2005/0063686 A1 3/2005 Whittle et al.
2005/0211711 A1 9/2005 Reid
2005/0268911 A1 12/2005 Cross et al.
2007/0074734 A1 4/2007 Braunshteyn et al.
2007/0102013 A1 5/2007 Adams
2007/0155255 A1 7/2007 Galauner et al.
2007/0204858 A1 9/2007 Abelbeck
2007/0204868 A1 9/2007 Bollinger
2007/0283972 A1 12/2007 Monsees
2008/0085139 A1 4/2008 Roof
2008/0092912 A1 4/2008 Robinson et al.
2008/0216828 A1 9/2008 Wensley et al.
2008/0233318 A1 9/2008 Coyle
2008/0302374 A1 12/2008 Wengert et al.
2009/0032034 A1 2/2009 Steinberg
2009/0056728 A1 3/2009 Baker
2009/0126745 A1 5/2009 Hon
2009/0151717 A1 6/2009 Bowen et al.
2009/0260641 A1 10/2009 Monsees
2009/0272379 A1 11/2009 Thorens et al.
2009/0304372 A1 12/2009 Gubler
2010/0126516 A1 5/2010 Yomtov et al.
2010/0200006 A1 8/2010 Robinson
2010/0242975 A1 9/2010 Hearn
2010/0300467 A1 12/2010 Kuistila
2011/0094523 A1 4/2011 Thorens
2011/0126848 A1 6/2011 Zuber
2011/0155153 A1 6/2011 Thorens et al.
2011/0226236 A1 9/2011 Buchberger
2011/0264084 A1 10/2011 Reid
2012/0006342 A1 1/2012 Rose et al.
2012/0234821 A1 * 9/2012 Shimizu ..... A24F 13/00 219/227
2012/0255546 A1 10/2012 Goetz et al.
2012/0260927 A1 10/2012 Liu
2013/0081623 A1 4/2013 Buchberger
2013/0133675 A1 * 5/2013 Shinozaki ..... A24F 47/008 131/329
2013/0306084 A1 * 11/2013 Flick ..... A24F 47/008 131/328
2014/0182608 A1 7/2014 Egoyants
2014/0182843 A1 7/2014 Vinegar
2014/0202476 A1 7/2014 Egoyants et al.
2014/0216485 A1 8/2014 Egoyants et al.
2014/0270726 A1 9/2014 Egoyants
2014/0283825 A1 9/2014 Buchberger
2014/0299125 A1 10/2014 Buchberger
2014/0305449 A1 * 10/2014 Plojoux ..... A24F 47/008 131/328
2014/0326257 A1 11/2014 Jalloul et al.
2014/0334802 A1 * 11/2014 Dubief ..... A61L 9/03 392/390
2014/0338680 A1 11/2014 Abramov et al.
2014/0360515 A1 12/2014 Vasiliev et al.

(56) References Cited

U.S. PATENT DOCUMENTS

| | | | |
|---|---|---|---|
| 2015/0040925 | A1 | 2/2015 | Saleem et al. |
| 2015/0223520 | A1 | 8/2015 | Phillips et al. |
| 2016/0003403 | A1 | 1/2016 | Smith |
| 2017/0095006 | A1 | 4/2017 | Egoyants et al. |
| 2017/0119048 | A1 | 5/2017 | Kaufman |
| 2017/0119049 | A1 | 5/2017 | Blandino |
| 2017/0119050 | A1 | 5/2017 | Blandino |
| 2017/0156406 | A1 | 6/2017 | Abramov et al. |
| 2017/0156407 | A1 | 6/2017 | Abramov |
| 2017/0197043 | A1 | 7/2017 | Buchberger |
| 2017/0197044 | A1 | 7/2017 | Buchberger |
| 2017/0197046 | A1 | 7/2017 | Buchberger |
| 2018/0271171 | A1 | 9/2018 | Abramov |

FOREIGN PATENT DOCUMENTS

| | | | |
|---|---|---|---|
| CN | 1045691 | | 10/1990 |
| CN | 1122213 | | 5/1996 |
| CN | 2246744 | Y | 2/1997 |
| CN | 119661 | | 10/1998 |
| CN | 2598364 | | 1/2004 |
| CN | 101238047 | | 8/2008 |
| CN | 101267749 | | 9/2008 |
| CN | 101277622 | | 10/2008 |
| CN | 201185656 | | 1/2009 |
| CN | 101557728 | | 10/2009 |
| CN | 201375023 | | 1/2010 |
| CN | 101925309 | | 12/2010 |
| CN | 201869778 | | 6/2011 |
| CN | 103054196 | A | 4/2013 |
| CN | 103359550 | | 10/2013 |
| DE | 29713866 | | 10/1997 |
| EP | 0358002 | | 3/1990 |
| EP | 0358114 | | 3/1990 |
| EP | 430566 | | 11/1990 |
| EP | 0430559 | | 6/1991 |
| EP | 0438862 | | 7/1991 |
| EP | 0488488 | | 6/1992 |
| EP | 0503767 | | 9/1992 |
| EP | 0603613 | | 6/1994 |
| EP | 2316286 | | 5/2001 |
| EP | 1618803 | | 1/2006 |
| EP | 1736065 | | 12/2006 |
| EP | 2022349 | | 2/2009 |
| EP | 2110033 | | 10/2009 |
| EP | 1947965 | | 2/2010 |
| EP | 2327318 | | 6/2011 |
| EP | 2340730 | | 7/2011 |
| EP | 2394520 | | 12/2011 |
| EP | 2520186 | | 11/2012 |
| GB | 26138 | | 3/1912 |
| GB | 426247 | | 3/1935 |
| JP | 62501050 | | 4/1987 |
| JP | 6217980 | | 8/1988 |
| JP | 63127399 | | 8/1988 |
| JP | 03192677 | | 8/1991 |
| JP | 03232481 | | 10/1991 |
| JP | H05-212100 | | 8/1993 |
| JP | 6189861 | | 7/1994 |
| JP | 06315366 | | 11/1994 |
| JP | 478508 | | 6/1996 |
| JP | 08000942 | | 6/1996 |
| JP | 09107943 | | 4/1997 |
| JP | 1189551 | | 4/1999 |
| JP | 11125390 | | 5/1999 |
| JP | 11169157 | | 6/1999 |
| JP | 2005036897 | | 2/2005 |
| JP | 2005106350 | | 4/2005 |
| JP | 2005300005 | A | 10/2005 |
| JP | 2006501871 | | 1/2006 |
| JP | 2008249003 | | 10/2008 |
| JP | 2009537120 | | 10/2009 |
| JP | 2010506594 | | 3/2010 |
| JP | 2010178730 | | 8/2010 |
| JP | 2010213579 | | 9/2010 |
| JP | 2011058538 | | 3/2011 |
| JP | 2011509667 | | 3/2011 |
| JP | 5193668 | | 5/2013 |
| JP | 2014/519586 | | 8/2014 |
| KR | 10-1999-0081973 | | 11/1999 |
| KR | 19990081973 | A | 11/1999 |
| KR | 100636287 | | 10/2006 |
| KR | 100757450 | | 9/2007 |
| KR | 1020080060218 | | 7/2008 |
| KR | 10-2010-0135865 | | 12/2010 |
| KR | 20100135865 | A | 12/2010 |
| KR | 10-2012-0104533 | | 9/2012 |
| KR | 20120104533 | A | 9/2012 |
| WO | WO8602528 | | 5/1986 |
| WO | WO 94/006314 | | 3/1994 |
| WO | WO 9418860 | | 9/1994 |
| WO | WO 9632854 | | 10/1996 |
| WO | WO 9823171 | | 6/1998 |
| WO | WO0167819 | | 9/2001 |
| WO | WO 03012565 | | 2/2003 |
| WO | WO03037412 | | 5/2003 |
| WO | WO03059413 | | 7/2003 |
| WO | WO 03070031 | | 8/2003 |
| WO | WO03103387 | | 12/2003 |
| WO | WO 2007012007 | | 1/2007 |
| WO | WO2007017482 | | 2/2007 |
| WO | WO2007131450 | | 11/2007 |
| WO | WO2008108889 | | 9/2008 |
| WO | WO2008121610 | | 10/2008 |
| WO | WO2009001082 | | 12/2008 |
| WO | WO 2009/022232 | | 2/2009 |
| WO | WO2009092862 | | 7/2009 |
| WO | WO2010073018 | | 7/2010 |
| WO | WO2010107613 | | 9/2010 |
| WO | WO2010118644 | | 10/2010 |
| WO | WO 2010133342 | | 11/2010 |
| WO | WO2011050964 | | 5/2011 |
| WO | WO 2011/063970 | | 6/2011 |
| WO | WO 2011/068020 | | 6/2011 |
| WO | WO2011079932 | | 7/2011 |
| WO | WO 2013/022936 | | 2/2013 |
| WO | WO 2013/034458 | | 3/2013 |
| WO | WO 2013/034459 | A1 | 3/2013 |
| WO | WO 2013034454 | | 3/2013 |
| WO | WO 2013034460 | | 3/2013 |
| WO | WO 2013/098395 | | 7/2013 |
| WO | WO 2013/131764 | A1 | 9/2013 |
| WO | WO 2013/160112 | | 10/2013 |
| WO | WO 2014/201432 | A1 | 12/2014 |
| WO | WO 2015/177254 | | 11/2015 |
| WO | WO 2017/153579 | | 9/2017 |

OTHER PUBLICATIONS

PCT Written Opinion of the International Searching Authority for PCT/EP2014/072828, dated Jun. 16, 2015, 5 pages.

Examination Report for corresponding NZ Application No. 718007 dated Aug. 1, 2016; 4 pages.

Application and File History for U.S. Appl. No. 14/127,144, filed Mar. 31, 2014, inventors Egoyants et al.

Application and File History for U.S. Appl. No. 14/127,133, filed Jul. 15, 2014, inventors Vasiliev et al.

International Search Report and Written Opinion, dated Jan. 9, 2013, for International Application No. PCT/EP2012/066523 filed Aug. 24, 2012.

International Preliminary Report on Patentability, dated Nov. 4, 2013, for International Application No. PCT/EP2012/066523 filed Aug. 24, 2012.

Search Report dated Mar. 24, 2015, for Chinese Patent Application No. 201280029767.6 filed Aug. 24, 2012.

International Search Report and Written Opinion, dated Jan. 9, 2013 for International Application No. PCT/EP2012/066524, filed Aug. 24, 2012.

International Preliminary Report on Patentability, dated Oct. 17, 2013 for International Application No. PCT/EP2012/066524, filed Aug. 24, 2012.

(56) References Cited

OTHER PUBLICATIONS

International Search Report and Written Opinion, dated Dec. 10, 2012, for PCT/EP2012/066485, filed Aug. 24, 2012.
Written Opinion, dated Oct. 15, 2013, for PCT/EP2012/066485, filed Aug. 24, 2012.
Office Action and Search Report (with English Translation) dated Apr. 27, 2015, for CN201280030681.5.
Office Action (with English Translation) dated Apr. 7, 2015 for JP2014519586.
Chinese First Office Action for Chinese Patent Application No. 201380021387.2 dated Dec. 3, 2015.
Korean Office Action, Application No. 10-2013-7033866, dated Jul. 27, 2018, 10 pages (22 pages with translation).
Warrier et al., "Effect of the Porous Structure of Graphite on Atomic Hydrogen Diffusion and Inventory". Nucl. Fusion 47(2007) 1656-1663, DOI: 10.1088/0029-5515/47/12/003.
Davies et al., (1983) Metallic Foams: Their Production, Properties and Applications. Journal of Materials Science, vol. 18 (7). p. 1899-1911.
International Search Report dated Jul. 18, 2011 issued in corresponding International Patent Application No. PCT/AT2011/000123.
International Search Report and Written Opinion, dated Jan. 9, 2013, for International Application No. PCT/EP2012/066484, filed Aug. 24, 2012.
International Search Report and Written Opinion dated Feb. 11, 2014 for PCT/EP2013/057539 filed Apr. 11, 2013.
International Search Report and Written Opinion dated Jan. 14, 2013 for PCT/EP2012/066486 filed Aug. 24, 2012.
International Preliminary Report on Patentability and response thereto dated Oct. 22, 2013 for PCT/EP2012/066486 filed Aug. 24, 2012.
Office Action (with English translation) dated Mar. 31, 2015 for JP2014-519585, referencing JP2010-506594, JP03-232481, JP2010-213579, JP62-17980, JP2006-501871, JP4-78508 and JP62-501050.
First Office Action (dated Jun. 15, 2015) and Search Report (dated Jun. 2, 2015) for Chinese Patent Application No. 201280029784.X filed Aug. 24, 2012.
International Search Report and Written Opinion dated Jan. 9, 2013 for PCT/EP2012/066525 filed Aug. 24, 2012.
Application and File History for U.S. Appl. No. 15/437,517 dated Feb. 21, 2017, inventors Abramov et al.
Application and File History for U.S. Appl. No. 14/343,368 dated Jun. 24, 2014, inventors Abramov et al.
Australian Examination Report, Application No. 2016204192, dated Feb. 21, 2018, 7 pages.
Chilean Office Action, Application No. 2014-002840, dated Jul. 20, 2017, 7 pages.
Notice of Opposition dated Mar. 7, 2017 for European Application No. 12750770.5.
Concept Group, Insulon® Thermal Barrier from Concept Group Blocks Heat with Hyper-Deep Vacuum™, Dec. 15, 2011. 1 page.
Japanese Office Action for Japanese Application No. 2015-506185 dated Sep. 29, 2015.
Korean Office Action, Application No. 10-2017-7017425, dated Sep. 6, 2017, 9 pages.
Korean Office Action, Application No. 10-2017-7017430, dated Sep. 6, 2017, 9 pages.
Patio Kits Direct, *Insulted Roof Panels*, DIY Alumawood Patio Cover Kits, dated Sep. 20, 2018, as available at www.patiokitsdirect.com/about-insulation, 2 pages.
Chinese 2nd Office Action for Chinese Application No. 201380021387.2 dated Jul. 8, 2016.
Korean Office Action for Korean Application No. 1020147032958 dated Aug. 17, 2016.
Second Office Action issued by the Chinese Patent Office for Chinese Patent Application No. 201380048636.7 dated Jan. 16, 2017.
Notice of EP Opposition by Fontem Ventures V.B., Application No. 12750765.5, dated Sep. 25, 2018, 22 pages.
Notice of EP Opposition by JT International S.A. , Application No. 12750765.5, dated Sep. 26, 2018, 67 pages.
National Plastic Heater, Sensor and Control Inc., 'Kapton (Polyimide) Flexible Heaters', 2011, retrieved Feb. 19, 2018, as available at : https://www.kapton-silicone-flexible-heaters.com/products/kapton_polyimide_flexible_heaters.html.
Korean Office Action for Korean Patent Application No. 10-2016-7010831, dated Jul. 28, 2017, 11 pages.
Japanese Office Action, for Japanese Patent Application No. 2016-527295, 9 pages.
Application and File History for U.S. Appl. No. 15/991,512 dated May 29, 2018, inventors Abramov et al.
European Extended Search Report, Application No. 18157257.9, dated Jun. 28, 2018, 7 pages.
Philippine Office Action, Application No. 1/2016/500805, dated Jan. 9, 2019, 6 pages.
Application and File History for U.S. Appl. No. 15/437,522 dated Feb. 21, 2017, inventors Abramov et al.
Japanese Office Action, Application No. 2016-527295, dated Jun. 27, 2017, 4 pages (7 pages with translation).
Korean Office Action, Application No. 10-2016-7010831, dated Jul. 28, 2017, (13 pages with translation).
Chinese Office Action, Application No. 201480059966.0, dated Dec. 26, 2017, 15 pages (29 pages with translation).
Collier, J. G. et al., "10.3 Mechanism of evaporation and condensation", Convective Boiling and Condensation Third Edition, Clarendon Press, (May 23, 1996), pp. 433-435, ISBN 0-19-856296-9, XP055543568.
Notice of Opposition, Application No. EP 12750771.3, dated Jan. 11, 2019, 44 pages.
Chinese First Office Action, Application No. 201710412726.X, dated Apr. 24, 2019, 21 pages.
India Examination Report, Application No. 201647014549, dated Aug. 28, 2019, 6 pages.
Korean Office Action, Application No. 10-2019-7037986, dated Feb. 6, 2020, 11 pages.
Japanese Office Action, dated Oct. 13, 2020, 5 pages.

* cited by examiner

APPARATUS FOR HEATING SMOKEABLE MATERIAL

CROSS REFERENCE TO RELATED APPLICATIONS

The present application is a National Phase entry of PCT Application No. PCT/EP2014/072828, filed Oct. 24, 2014, which claims priority from U.S. Provisional Patent Application No. 61/897,193, filed Oct. 29, 2013, said applications being hereby incorporated by reference herein in their entireties.

TECHNICAL FIELD

The present disclosure relates to apparatus arranged to heat smokable material.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first aspect of embodiments, there is provided an apparatus arranged to heat smokable material to volatilize at least one component of said smokable material, the apparatus comprising: a housing; and a plurality of heater segments longitudinally arranged within the housing for heating smokable material contained within the apparatus; wherein at least one heater segment is arranged so as to heat smokable material contained within said at least one heater segment more quickly than at least one other heater segment heats smokable material contained within said at least one other heater segment.

By arranging the at least one heater segment in this way, the smokable material in that heater segment will volatilize more quickly in use, which enables the user to inhale more quickly once the apparatus is first put to use.

In an exemplary embodiment, said at least one heater segment defines a smaller volume than said at least one other heater segment. In an exemplary embodiment, said at least one heater segment is shorter than said at least one other heater segment in the longitudinal direction of the housing.

In an exemplary embodiment, said at least one heater segment has a lower heat capacity than said at least one other heater segment.

In an exemplary embodiment, the heater segments are generally hollow cylinders for containing smokable material to be heated therein.

In an exemplary embodiment, the apparatus comprises power circuitry constructed and arranged so that the heater segments can be selectively powered independently of each other.

According to a second aspect of embodiments, there is provided an apparatus arranged to heat smokable material to volatilize at least one component of said smokable material, the apparatus comprising: a housing; a plurality of heater segments longitudinally arranged within the housing for heating smokable material contained within the apparatus; and at least one mechanical isolator; said at least one mechanical isolator being arranged between two adjacent heater segments and being constructed and arranged to support said adjacent heater segments and maintain a longitudinal separation between said adjacent heater segments.

The mechanical isolators of an exemplary embodiment are rigid so as to provide mechanical, structural support for the heater segments. In exemplary embodiments, the mechanical isolators act to maintain a separation or air gap between the heater segments and other components, which helps to reduce or minimize heat loss from the heater segments.

In an exemplary embodiment, the heater segments are generally hollow cylinders for containing smokable material to be heated therein, and wherein the at least one mechanical isolator is correspondingly annular.

In an exemplary embodiment, an end wall of the mechanical isolator has plural contact projections which make contact with the heater segment that is adjacent said end wall. In an exemplary embodiment, the contact projections can be arranged so that the contact area between the heater segment and the mechanical isolator is small, and also effectively to create an air gap between the contact projections, which help to minimize heat loss from the heater segment.

In an exemplary embodiment, the mechanical isolator has at least one wire guide projection for guidably supporting an electrical wire which passes over at least one of the heater segments. In an example, the wire guide projection holds the wire away from the main outer surface of the mechanical isolator and away from the outer surface of the heater segment. In an exemplary embodiment, the at least one wire guide projection has two ears between which an electrical wire can be located.

In an exemplary embodiment, the at least one wire guide projection is arranged to contact an adjacent heater segment to support said adjacent heater segment. The contact of the at least one wire guide projection may be with an outer surface of said adjacent heater segment in an example.

In an exemplary embodiment, the mechanical isolator has an outwardly facing circumferential rib for supporting an electrical wire which passes over the mechanical isolator.

In an exemplary embodiment, the apparatus comprises a sleeve contained within the housing, the heater segments being supported within the sleeve by the at least one mechanical isolator. In an exemplary embodiment, the sleeve is a double-walled sleeve which provides a low pressure region between the two walls of the sleeve. Such an example further serves to insulate and minimize heat loss from the heater segments.

In an exemplary embodiment, the apparatus comprises a plurality of annular supports which support the sleeve within the housing, with the sleeve being mounted within the annular supports and the annular supports being mounted within the housing.

According to a third aspect of embodiments, there is provided an apparatus arranged to heat smokable material to volatilize at least one component of said smokable material, the apparatus comprising: an outer housing; a sleeve contained within the outer housing; at least one heater segment within the sleeve for heating smokable material contained within the apparatus; and a plurality of annular supports which support the sleeve within the outer housing, with the sleeve being mounted within the annular supports and the annular supports being mounted within the outer housing.

In an example, the annular supports can be arranged to hold the sleeve away from the outer housing, minimizing conduction of heat from the sleeve to the outer housing.

In an exemplary embodiment, the annular supports provide the only support for the sleeve within the housing.

In an exemplary embodiment, each of the annular supports has plural inwardly facing contact projections which make contact with the sleeve. This helps to minimize heat conduction from the sleeve to the annular supports.

In an exemplary embodiment, an outwardly facing surface of the sleeve has at least one of an annular groove and at least one recess which receives a portion of one of the annular supports to locate the annular support on the sleeve.

In an exemplary embodiment, the annular supports are located away from the ends of the sleeve.

In an exemplary embodiment, the annular supports are positioned substantially equidistantly along the total length of the sleeve.

In an exemplary embodiment, the annular supports are respectively positioned substantially ⅓ of the total length of the heater support sleeve away from the ends of the heater support sleeve, and comprising at least one further annular support located between the outermost annular supports.

In an exemplary embodiment, the sleeve is a double-walled sleeve which provides a low pressure region between the two walls of the sleeve.

In an exemplary embodiment, the housing is a relatively poor heat conductor, the internal face of the housing being provided with at least a partial coating of a relatively good heat conductor to conduct heat away from positions where the annular supports contact the internal face of the housing.

In an exemplary embodiment, the outer housing has at least one air inlet and the heater segment has at least one air inlet, and comprising an air inlet pipe providing fluid communication from the outer housing air inlet to the heater segment air inlet, the arrangement being such that air can be drawn in through the outer housing air inlet, through the air inlet pipe, through the heater segment air inlet and over smokable material contained within the apparatus. In an exemplary embodiment, the apparatus is constructed and arranged such that the air inlet or air inlets of the outer housing are the only entry point(s) for air to be drawn into the apparatus in use.

In an exemplary embodiment, the apparatus comprises control circuitry contained within the outer housing for controlling the supply of electrical power to the at least one heater segment, the arrangement being such that air drawn in through the outer housing air inlet does not pass over the control circuitry.

In an exemplary embodiment, the outer housing has first and second air inlets on opposed sides of the outer housing, the air inlet pipe having a generally T-shape or Y-shape cross-section providing first and second arms which connect to the first and second outer housing air inlets respectively and a stem which is in fluid communication with the heater segment air inlet.

According to a fourth aspect of embodiments, there is provided an apparatus arranged to heat smokable material to volatilize at least one component of said smokable material, the apparatus comprising: an outer housing, the outer housing having at least one air inlet; at least one heater segment contained within the outer housing for heating smokable material contained within the apparatus, the heater segment having at least one air inlet; and an air inlet pipe providing fluid communication from the outer housing air inlet to the heater segment air inlet; the arrangement being such that air can be drawn in through the outer housing air inlet, through the air inlet pipe, through the heater segment air inlet and over smokable material contained within the apparatus.

The use of an air inlet pipe in an exemplary embodiment enables better control of the air flow through the apparatus.

In an exemplary embodiment, the apparatus is constructed and arranged such that the air inlet or air inlets of the outer housing are the only entry point(s) for air to be drawn into the apparatus in use.

In an exemplary embodiment, the apparatus comprises control circuitry contained within the outer housing for controlling the supply of electrical power to the at least one heater segment, the arrangement being such that air drawn in through the outer housing air inlet does not pass over the control circuitry.

In an exemplary embodiment, the outer housing has first and second air inlets on opposed sides of the outer housing, the air inlet pipe having a generally T-shape or Y-shape cross-section providing first and second arms which connect to the first and second outer housing air inlets respectively and a stem which is in fluid communication with the heater segment air inlet.

BRIEF DESCRIPTION OF THE DRAWINGS

Embodiments will now be described, by way of example only, with reference to the accompanying drawings, in which.

DETAILED DESCRIPTION

As used herein, the term "smokable material" includes materials that provide volatilized components upon heating, typically in the form of an aerosol. "Smokable material" includes any tobacco-containing material and may, for example, include one or more of tobacco, tobacco derivatives, expanded tobacco, reconstituted tobacco or tobacco substitutes. "Smokable material" also may include other, non-tobacco, products, which, depending on the product, may or may not contain nicotine.

Figure 1:
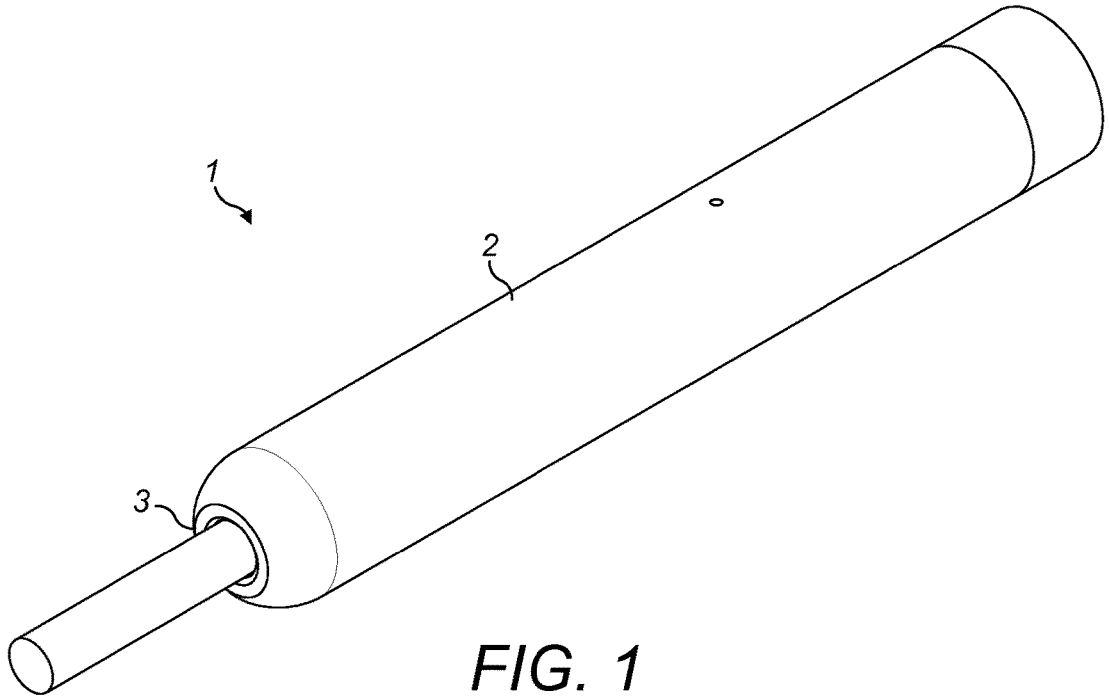
FIG. 1 shows a perspective view of an example of an apparatus for heating a smokable material.

Referring to FIG. 1, there is shown a perspective view of an example of an apparatus 1 arranged to heat smokable material to volatilize at least one component of said smokable material, typically to form an aerosol which can be inhaled. The apparatus 1 is a heating apparatus 1 which releases compounds by heating, but not burning, the smokable material. The apparatus 1 in this example is generally elongate, having a generally elongate cylindrical outer housing 2 of circular cross-section. The outer housing 2 has an open end 3, some times referred to herein as the mouth end.

Figure 2:
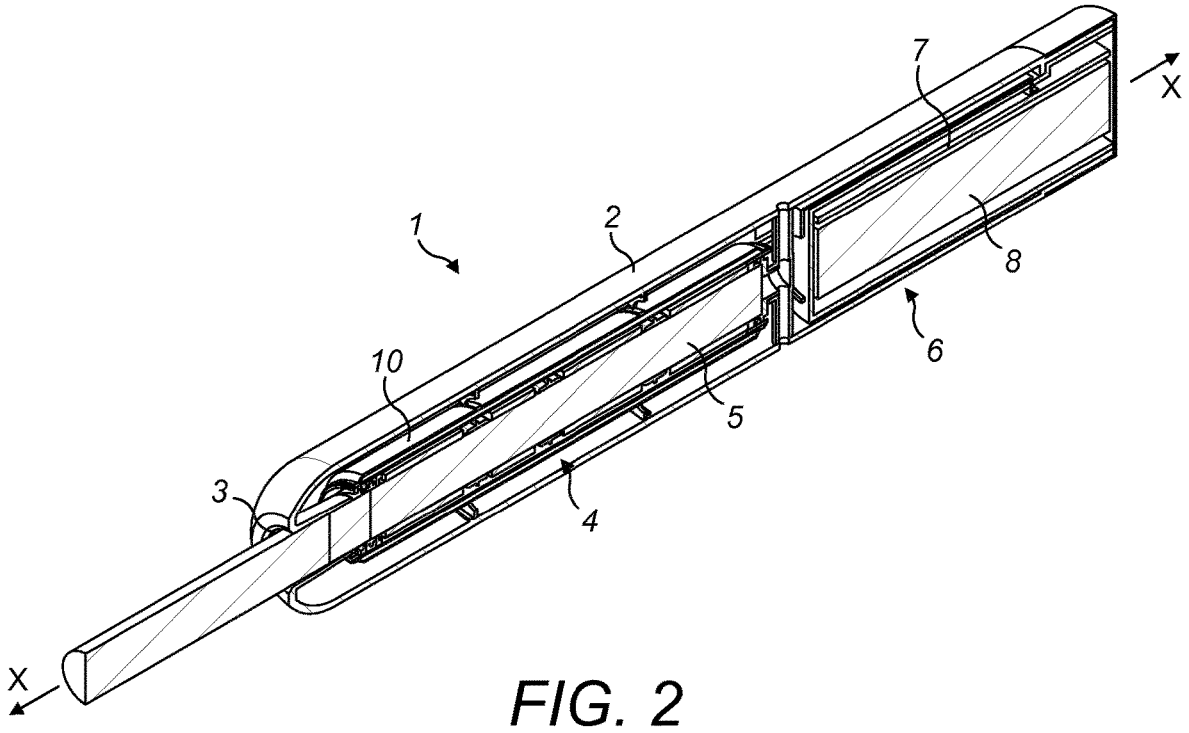
FIG. 2 shows a cross-sectional perspective view of the apparatus of FIG. 1.

Referring particularly to the cross-sectional view of FIG. 2, the apparatus 1 has a heating chamber 4 which in use contains the smokable material 5 to be heated and volatilized. The smokable material 5 may be in the form of a cartridge or cassette or rod which can be inserted into the apparatus 1. An end of the smokable material 5 projects out of the apparatus 1 through the open end 3 of the housing 2, typically for connection to a filter or the like, which may be a separate item or provided with the smokable material 5, through which a user inhales in use. The apparatus 1 further has an electronics/power chamber 6 which in this example contains electrical control circuitry 7 and a power source 8. In this example, the heating chamber 4 and the electronics/power chamber 6 are adjacent each other along the longitudinal axis X-X of the apparatus 1. In the example shown, the electronics/power chamber 6 is remote from the mouth end 3, though other locations are possible. The electrical control circuitry 7 may include a controller, such as a microprocessor arrangement, configured and arranged to control the heating of the smokable material as discussed further below.

The power source 8 may be a battery, which may be a rechargeable battery or a non-rechargeable battery. Examples of suitable batteries include for example a lithium-ion battery, a nickel battery (such as a nickel-cadmium battery), an alkaline battery and/or the like. A particularly preferred type of battery is a $LiFePO_4$ battery. The battery 8 is electrically coupled to the one or more heating elements (to be discussed further below) of the heating chamber 4 to supply electrical power when required and under control of the electrical control circuitry 7 to heat the smokable material (as discussed, to volatilize the smokable material without causing the smokable material to burn). In this example, the battery 8 is contained within a printed circuit board of the electrical control circuitry 7. In other examples, the battery 8 and the electrical control circuitry 7 may be arranged differently, such as for example arranged adjacent each other along the longitudinal axis X-X of the apparatus 1.

Figure 3:
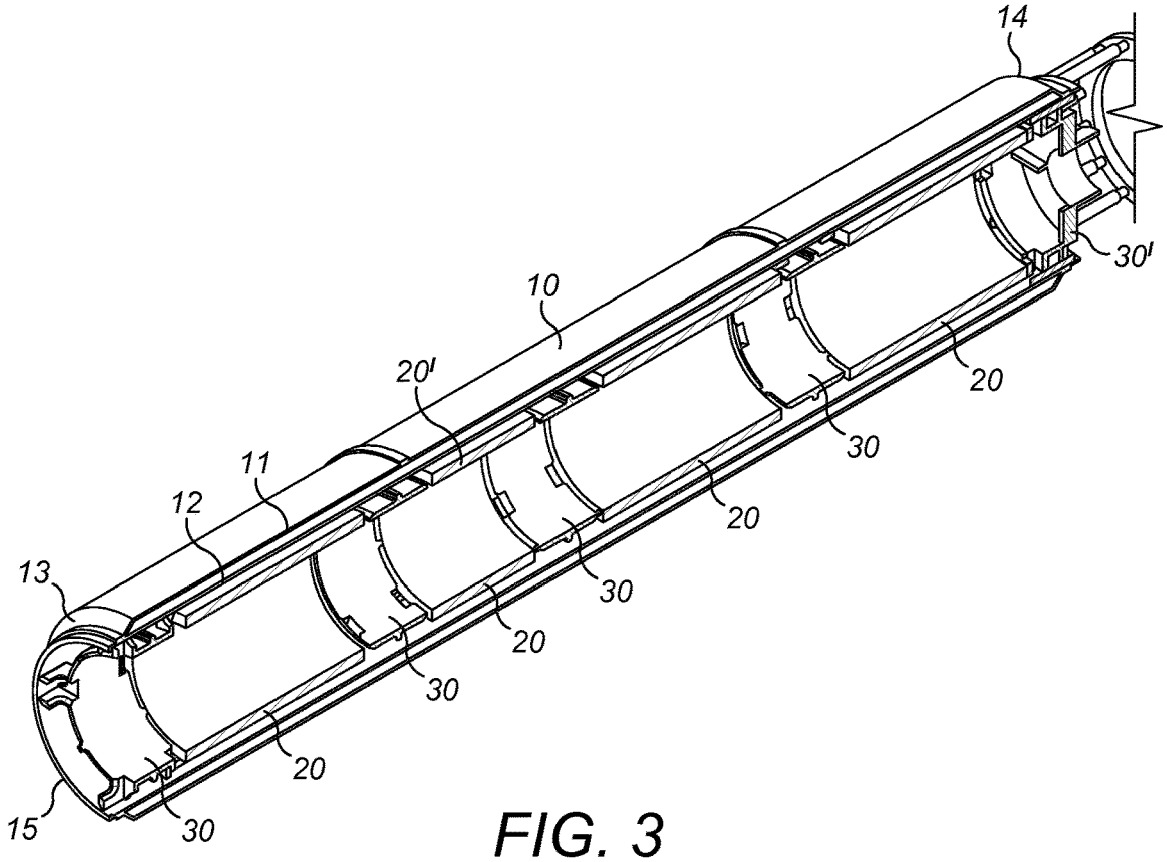
FIG. 3 shows a cross-sectional perspective view of an example of a heater support sleeve and heating chamber suitable for use in the apparatus of FIG. 1.

The heating chamber 4 is contained within a heater support sleeve 10, which is contained within the outer housing 2. In this example, the heater support sleeve 10 is a generally elongate cylinder of circular cross-section. Further, and referring particularly to FIGS. 3 and 4, in an example, the heater support sleeve 10 is a double-walled sleeve. Thus, the heater support sleeve 10 has an outer cylindrical wall 11 and an inner cylindrical wall 12 which are separated by a small separation d. As just one example and to give an idea of scale, the heater support sleeve 10 may be around 50 mm long and have an outer diameter of around 9 mm, and the separation d may be around 0.1 mm to 0.12 mm or so. The outer and inner cylindrical walls 11,12 are joined at each end 13,14. In one example, the joining is achieved by brazing. One of the functions of the heater support sleeve 10 in one example is to assist in heat-insulating the outer housing 2 from the heating chamber 4, so that the outer housing 2 does not become hot or at least too hot to touch during use. The space between the outer and inner cylindrical walls 11,12 may contain air. However, the space between the outer and inner cylindrical walls 11,12 is advantageously evacuated to improve the heat insulating properties of the heater support sleeve 10. As an alternative, the space between the outer and inner cylindrical walls 11, 12 may be filled with some other insulating material, including a suitable foam-type material for example. The material of the heater support sleeve 10 is advantageously such that the heater support sleeve 10 is rigid to provide structural stability for the components mounted therein. An example of a suitable material is stainless steel. Other suitable materials include polyether ether ketone (PEEK), ceramics, glass, steel, aluminum, etc. Furthermore, one or more of the innermost and outermost surfaces of each of the outer and inner walls 11, 12 of the heater support sleeve 10 may be reflective to infrared radiation so as to minimize infrared radiation heat losses out of the heater support sleeve 10. For example, one or more of the innermost and outermost surfaces of each of the outer and inner walls 11,12 may be coated with a material that is particularly reflective to at least infrared radiation to improve the heat-reflective and therefore insulating properties of the heater support sleeve 10. An example of a suitable coating is a thin layer of gold or other reflective metal layer.

In one example of the apparatus 1, the heater support sleeve 10 contains at least one heating element. In the example shown in the drawings, the heater support sleeve 10 contains plural heating elements or heater segments 20. There are advantageously at least two heater segments 20, though arrangements with other numbers of heater segments 20 are possible. In the particular example shown, there are four heater segments 20. In this example, the heater segments 20 align along or parallel to the longitudinal axis X-X of the heater support sleeve 10. The electrical control circuitry 7 and the power connections to the heater segments 20 are advantageously arranged such that at least two, and more advantageously all, of the heater segments 20 can be powered independently of each other, so that selected zones of the smokable material 5 can be independently heated, for example in turn (over time) or together (simultaneously) as desired. In this particular example, the heater segments 20 are generally annular or cylindrical, having a hollow interior which in use contains the smokable material 5.

In an example, the heater segments 20 may be made of a ceramics material. Examples include alumina and aluminum nitride and silicon nitride ceramics, which may be laminated and sintered. Other heating arrangements are possible, including for example infrared heater segments 20, which heat by emitting infrared radiation, or resistive heating elements formed by for example a resistive electrical winding around the heater segments 20.

In an example, one 20' of the heater segments 20 may be such as to contain or define a volume that has a lower heat capacity or thermal mass, and/or itself may have a lower heat capacity or thermal mass, than the other heater segment or segments 20. This means that, at least for the same or similar supplied power, the interior of the heater segment 20' that has a lower heat capacity and/or defines a volume of lower heat capacity will heat more quickly than the interior of the other heater segments 20. This means that the smokable material 5 in that heater segment 20' will volatilize more quickly, which enables the user to inhale more quickly once the apparatus 1 is first put to use. It is preferred that this heater segment 20' is close to the mouth end 3, and it may therefore be for example the first or second heater segment 20 in sequence moving away from the mouthpiece 3. In the example shown in FIG. 3, this heater segment 20' is the second closest to the mouthpiece 3.

In one example, this more rapid heating in a localized region of the smokable material can be achieved by the heater segment 20' that has or defines a lower heat capacity itself having or defining a smaller volume. In the example shown in FIG. 3, the volume of this heater segment 20' is smaller by virtue of the longitudinal axial length of the heater segment 20' being shorter than the longitudinal axial length(s) of the other heater segment(s) 20, with the internal radius of each heater segment 20, 20' being the same. Alternatively or additionally, the volume of this heater segment 20' is smaller by virtue of the internal radius of this heater segment 20' being smaller than the internal radius of the other heater segment(s) 20. As another alternative or additional arrangement, different materials having a lower specific heat capacity may be used for this heater segment 20' so that this heater segment 20' has a smaller heat capacity as a whole and will therefore heat more quickly. As another alternative or additional arrangement, this heater segment 20' may have thinner walls compared to the other heater segment(s) 20 so that this heater segment 20' will therefore heat more quickly.

In an example, the heater segments 20 are mounted and supported within the heater support sleeve 10 by mechanical isolators 30. The mechanical isolators 30 are rigid so as to provide mechanical, structural support for the heater segments 20. The mechanical isolators 30 act to maintain a separation or air gap between the heater segments 20 and the heater support sleeve 10, so as to reduce or minimize heat loss from the heater segments 20 to the heater support sleeve 10. The mechanical isolators 30 can be regarded as suspension elements which suspend the heater segments 20 within the heater support sleeve 10. The mechanical isolators 30 act also to maintain a desired separation between adjacent heater segments 20. This separation assists in minimizing heat transfer between the heater segments 20. The mechanical isolators 30 are advantageously formed of a heat insulating material. A particularly suitable material is polyether ether ketone (PEEK), which is a semi-crystalline thermoplastic with excellent mechanical and chemical resistance properties which are retained to high temperatures. However, other plastics, or other heat insulating materials, may be used.

The mechanical isolators 30 of one example are generally annular. As can be seen most clearly in for example FIGS. 4 and 5, the end surfaces of the mechanical isolators 30 of this example are formed with a plurality of small contact projections or pips or posts 31 which project axially outwards, towards the adjacent heater segment 20 in the assembled apparatus 1. The radius of the mechanical isolators 30 in this example is substantially the same as the radius of the heater segments 20 such that the contact projections 31 touch the opposed end surface of the adjacent heater segment 20. Accordingly, this minimizes the contact area between the adjacent end surfaces of the mechanical isolators 30 and the heater segments 20 as the contact projections 31 provide the only contact between these adjacent end surfaces. Also, an insulating air gap is effectively created between adjacent contact projections 31. The contact projections 31 therefore help to minimize heat conduction from a heater segment 20 to an adjacent mechanical isolator 30. This in turn maximizes the heat transfer to smokable material 5 within the heater segment 20, so minimizing the time required to heat the smokable material 5 and minimizing power usage.

Figure 6:
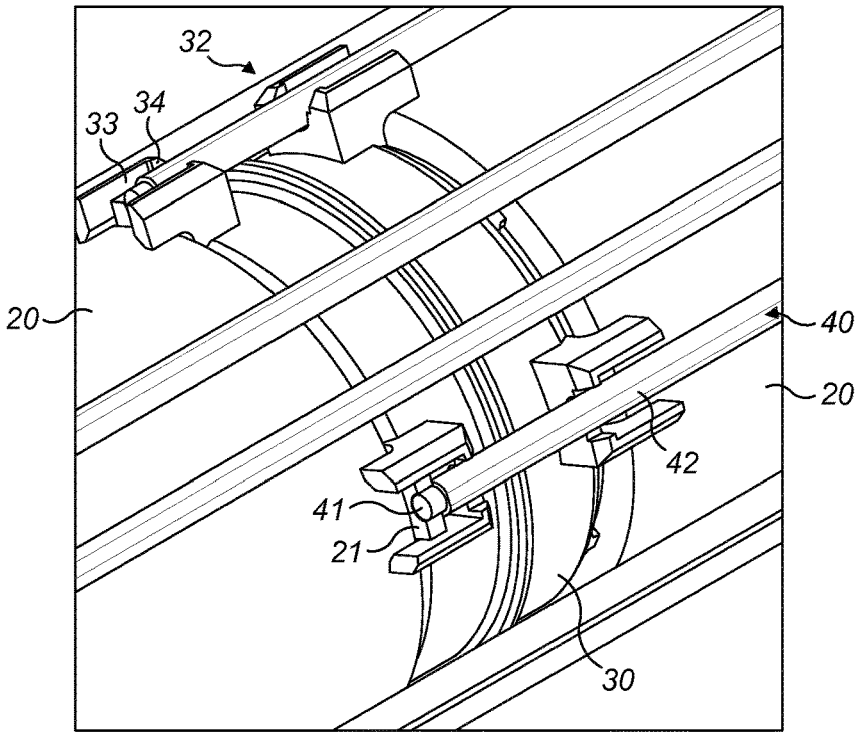
FIG. 6 shows a detailed perspective view of an example of a mechanical isolator between two heater segments suitable for use in the apparatus of FIG. 1.
Figure 7:
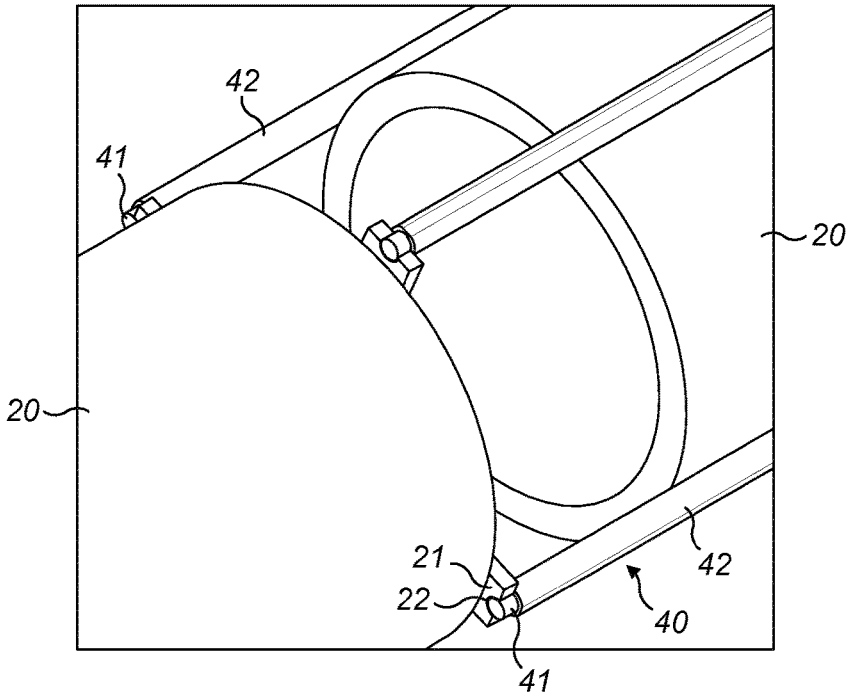
FIG. 7 shows a detailed perspective view of wire connections to a heater segment suitable for use in the apparatus of FIG. 1.

Electrical wires are provided to provide electrical power from the power source 8 to each of the heater segments 20. In an example, each heater segment 20 is capable of being powered independently of each other heater segment 20, so there are two power electrical wires for each heater segment 20 in such a case. As shown in FIGS. 6 and 7 for example, the electrical wires 40 in this example have a metal or other electrically conductive core 41 surrounded by an insulating sleeve 42, with the core 41 being exposed at the ends of the electrical wires 40. The sleeve 42 may be formed of for example polyether ether ketone (PEEK), though other plastics, or other heat insulating materials, may be used. The exposed ends of the cores 41 are connected to the respective heater segments 20. In the example shown in FIGS. 6 and 7, the heater segments 20 have connection tabs or posts 21 which face radially outwardly of the heater segments 20. In the example shown, the connection posts 21 are notched to provide recesses 22 into which the exposed ends of the wire cores 41 fit. (In FIG. 7, the mechanical isolator 30 between adjacent heater segments 20 is omitted to show the connection of the wires 40 more clearly.) The connection posts 21 may be integrally formed with the heater segments 20, or may be provided as separate items that are attached to the heater segments 20. Where provided as a separate item, a particularly suitable material for the connection posts 21 is Kovar, a nickel-cobalt ferrous alloy. As an alternative to the use of recessed connection posts 21, the exposed ends of the cores 41 may be fixed directly to the heater segments 20, such as by soldering for example.

Figure 8:
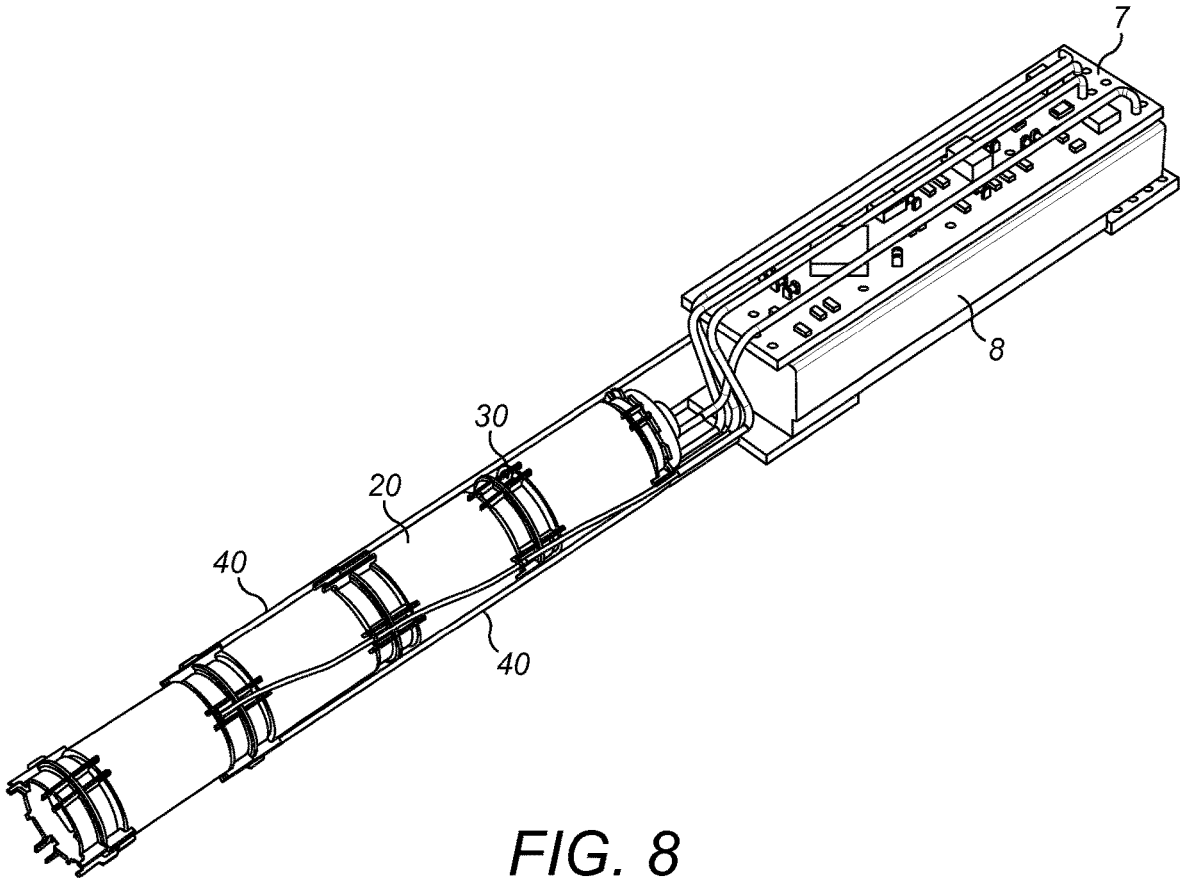
FIG. 8 shows a schematic perspective view of wires passing to and from electrical control circuitry and/or a power source to heater segments suitable for use in the apparatus of FIG. 1.

In some examples, each heater segment 20 has two connection posts 21 for the two electrical power wires 40. In some examples, at least one of the heater segments 20, and optionally all of the heater segments 20, may have a further pair of connection posts 21 for receiving further electrical wires 40. These further electrical wires 40 may provide for resistive temperature detection for the heater segment 20 to which they are connected. That is, the further electrical wires 40 provide for a measure of the temperature of the corresponding heater segment 20 to be passed back to the electrical control circuitry 7, which in turn controls the power supplied to the heater segment 20 to control the temperature to be at a desired level or within a desired range. It may be noted that not all heater segments 20 need be provided with an independent temperature sensing arrangement. It may for example be sufficient for just some or even just one of the heater segments 20 to have a temperature sensing arrangement. Indeed, the temperature sensing need not in all cases be related to a particular heater segment 20, and instead the temperature may be measured at some other location within the apparatus 1. As an alternative to resistive temperature detection, one or more thermistors may be used for detecting temperature within one or more of the heating segments 20 or the apparatus 1 as a whole. FIG. 8 shows schematically wires 40 passing to and from the electrical control circuitry 7 and the power source 8 to the heater segments 20. In this example, there are shown two electrical wires 40 providing for power to each heater segment 20 respectively.

In an example, the mechanical isolators 30 are provided with projections 32 to hold and support the heater segments 20. In one example, the projections 32 are formed as one or more posts or ears 33 which stand radially outwardly of the mechanical isolator 30 and are arranged parallel to the longitudinal axis X-X of the apparatus 1. The post or posts 33 of the projections 32 effectively cradle a heater segment 20, whilst again minimizing contact between the mechanical isolators 30 and the heater segments 20 and maximizing minimizing the presence of insulating air gaps.

In an example, one or more of the projections 32 is formed as a pair of posts or ears 33 which define a short channel into which an electrical wire 40 fits. In this example, the one or more of the projections 32 acts also as a wire guide to support and guide the electrical wires 40. In one arrangement, opposed ends 34 of the guide projection ears 33 are angled in towards each other to provide inwardly facing posts, thereby providing a narrow portion which grips the electrical wire 40. The bases of the guide projections 32 may have a recess 35 which receives the electrical wire 40. The recess 35 is positioned radially outwardly of the main outermost surface of the mechanical isolator 30 such that the electrical wires 40 are held away from the surface of the isolator 30 and away from the outer surface of the heater segment 20 to prevent or minimize heating of the electrical wires 40. For similar reasons, the mechanical isolator 30 may have a circumferential rib 36 projecting radially outwardly, again to help maintain the electrical wires 40 away from the mechanical isolators 30 and the heater segments 20. Thus, depending on the particular arrangement and the number of electrical wires 40 and the number of guide projections 32, typically in some examples the electrical wires 40 for a particular heater segment 20 (whether they are power wires or temperature-sensor wires) are held by guide projections 32 of an adjacent mechanical isolator 30, whereas other electrical wires 40 for other heater segments 20 merely pass over that mechanical isolator 30 but are supported by the circumferential rib 36 of that mechanical isolator 30. An example of this can be seen in the example of FIG. 6.

It should be noted that the wire guide function of the projections 32 may be provided separately of the function of supporting the heater segments 20, so for example there may be projections 32 that only support the heater segments 20, projections 32 that only guide the electrical wires 40, and optionally some projections 32 that both support the heater segments 20 and guide the electrical wires 40.

Figure 4:
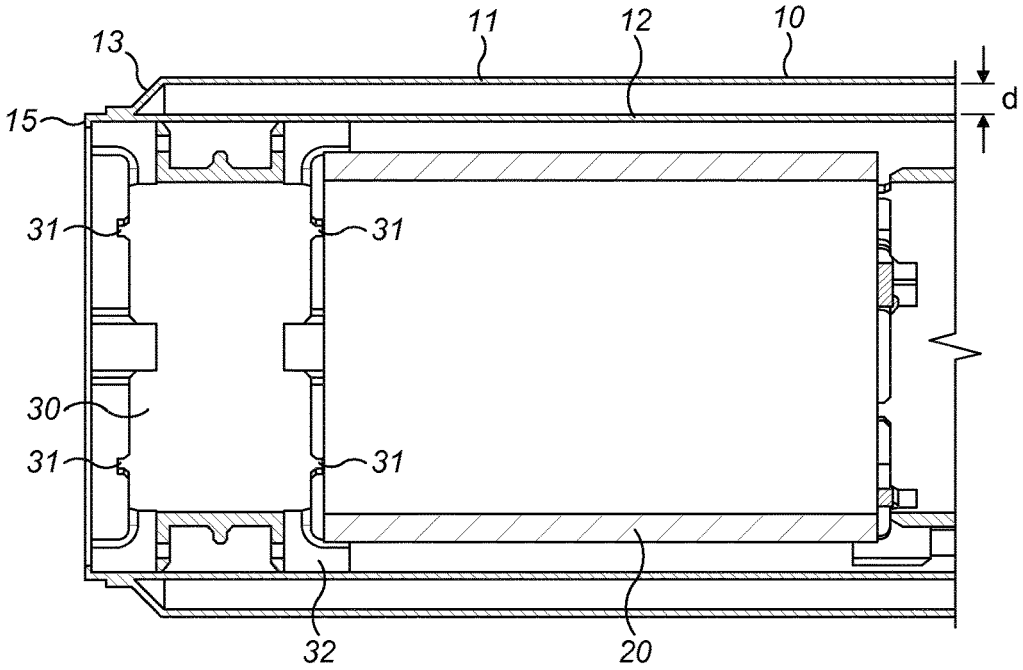
FIG. 4 shows a longitudinal cross-sectional view of a portion of an example of a heater support sleeve and heating chamber suitable for use in the apparatus of FIG. 1.
Figure 5:
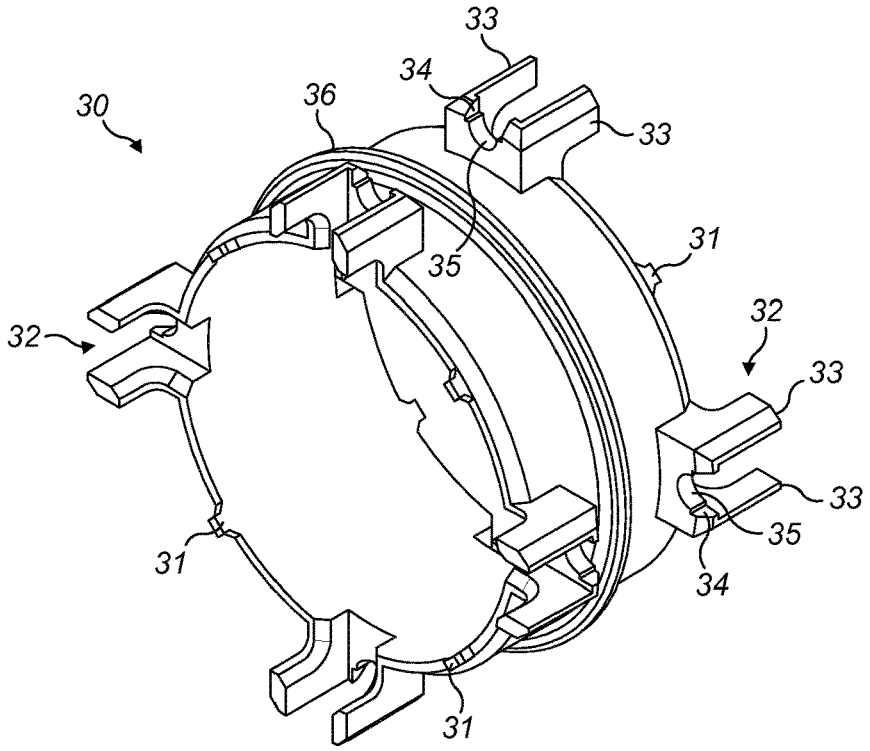
FIG. 5 shows a perspective view of an example of a mechanical isolator suitable for use in the apparatus of FIG. 1.

As can be seen most clearly in FIG. 4 for example, the frontmost portion of the double-walled heater support sleeve 10 may be provided with an annular lip 15 which faces radially inwards to retain the frontmost mechanical isolator 30 within the heater support sleeve 10. In the example shown, this lip 15 engages with the forwards facing guide projections 32 of the frontmost mechanical isolator 30. This has the advantage of minimizing the contact area between the frontmost mechanical isolator 30 and the lip 15 of the heater support sleeve 10. It may be noted however that this frontmost mechanical isolator 30 may be formed differently at its frontmost face. For example, the frontmost face of this frontmost mechanical isolator 30 may be formed with simple small pips or projections that touch the lip 15 to minimize further the contact area. As another example, the frontmost face of this frontmost mechanical isolator 30 may be formed with no projections of any type, if for example minimizing the contact area between the frontmost mechanical isolator 30 and the lip 15 of the heater support sleeve 10 is not a particular concern. A similar arrangement of an annular lip at the rearmost portion of the double-walled heater support sleeve 10 may alternatively be provided to retain the rearmost mechanical isolator 30 within the heater support sleeve 10. As another alternative, the mechanical isolators 30 may be retained within the heater support sleeve 10 by use of one or more separate retainers, in the form of for example one or more retainer rings at the front and/or rear of the heater support sleeve 10. As another alternative, the mechanical isolators 30 may be held within the heater support sleeve 10 by one or more retainers, grooves, indentations or the like, provided on or integrally formed with the outer housing 2. Alternatively or additionally, the heater support sleeve 10 and the mechanical isolators 30 may be dimensioned so that the mechanical isolators 30 are a snug fit within the heater support sleeve 10.

Figure 9:
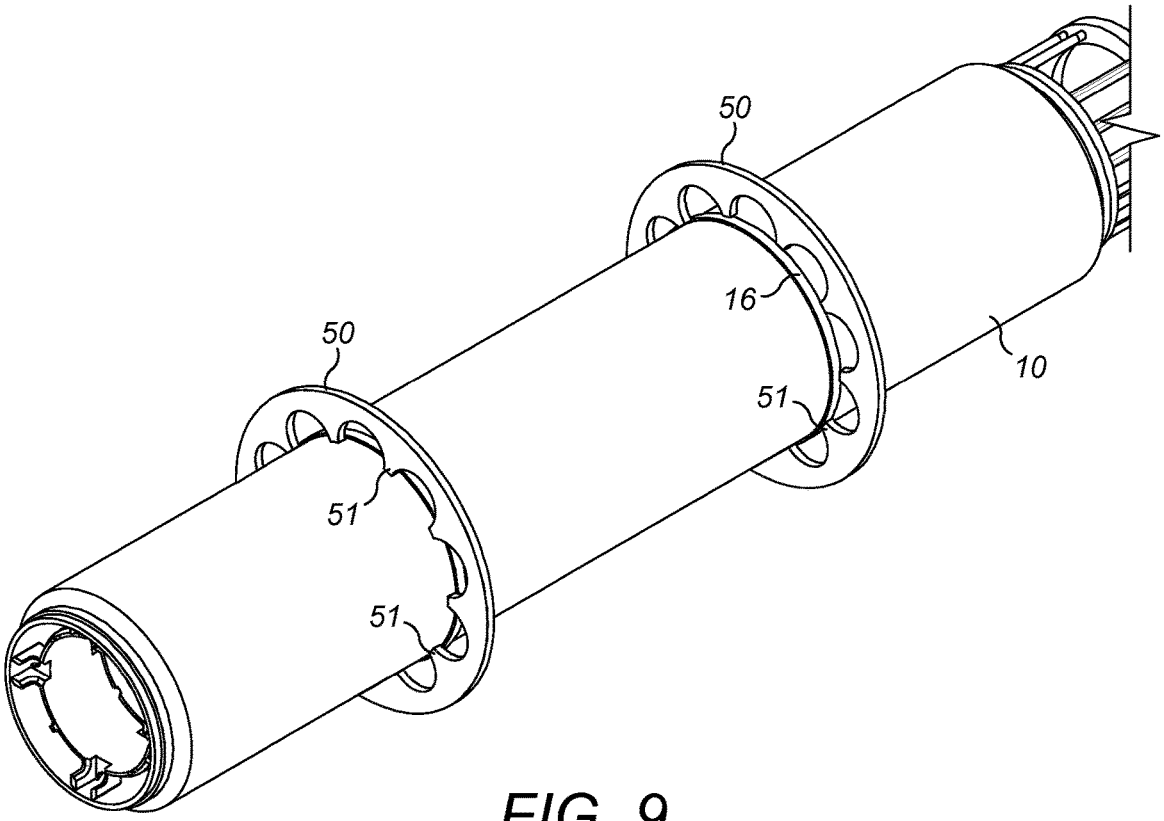
FIG. 9 shows a perspective view of an example of a heater support sleeve and supports suitable for use in the apparatus of FIG. 1.
Figure 10:
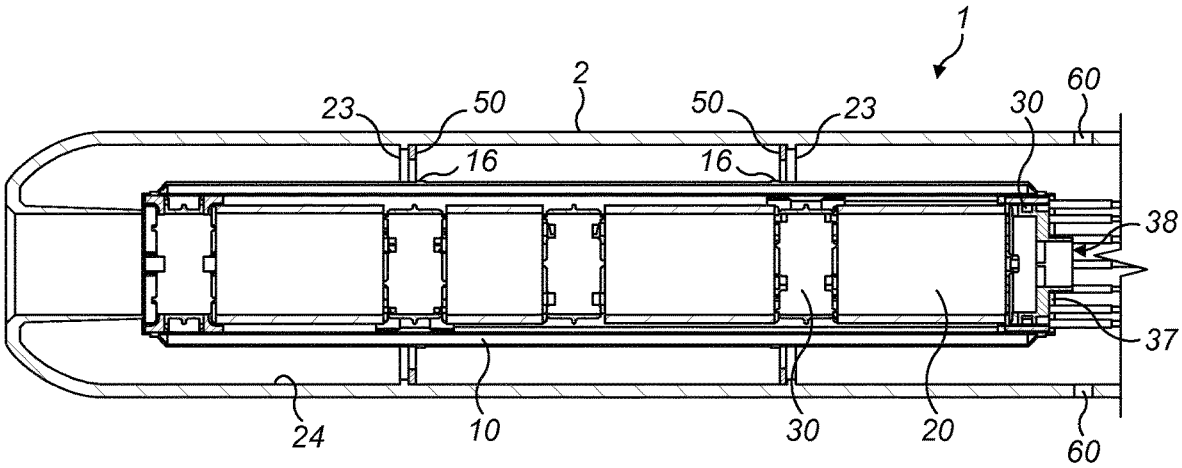
FIG. 10 shows a longitudinal cross-sectional view of an example of the frontmost portion of an apparatus for heating a smokable material.

As mentioned above, one of the functions of the heater support sleeve 10 in one example is to assist in heat-insulating the outer housing 2 from the heating chamber 4, so that the outer housing 2 does not become hot or at least too hot to touch during use. To assist in this, the heater support sleeve 10 is spaced from the outer housing 2. In an example shown in FIGS. 9 and 10, this is achieved by use of one or more annular supports 50. The annular support or supports 50 may be arranged to minimize heat conduction from the heater support sleeve 10 to the annular supports 50. In the example shown, this is achieved by the annular supports 50 having plural inwardly facing contact projections 51 which provide the only contact between the annular supports 50 and the heater support sleeve 10. In the example shown, the contact projections 51 taper towards the center of the annular support 50 to provide a small contact area. Further, in an example, the heater support sleeve 10 has an external circumferential rib 16 for the or each annular support 50, against which the corresponding annular support 50 abuts. Similarly, in an example, the outer housing 2 of the apparatus 1 has an internal circumferential rib 23 for the or each annular support 50, against which the corresponding annular support 50 abuts. The respective circumferential ribs 16,23 of the heater support sleeve 10 and outer housing 2 may be located so that the corresponding annular support 50 is sandwiched between the respective circumferential ribs 16,23.

The or each annular support 50 may be located away from the ends of the heater support sleeve 10. This is of particular advantage in the case that the heater support sleeve 10 is a double-walled vacuum sleeve as discussed above. This is because the heat insulating property of the double-walled heater support sleeve 10 is generally good except at the ends 13,14 because that is where the two walls 11,12 meet. In one example, there are two annular supports 50. This provides a good compromise between providing adequate support for the heater support sleeve 10 within the apparatus 1 and yet minimizing contact with the heater support sleeve 10, thereby minimizing heat conduction losses from the heater support sleeve 10. With such an arrangement, the annular supports 50 may each be respectively located at or approximately ⅓ along the length of the heater support sleeve 10 from each end of the sleeve 10. Other locations are however possible. In one arrangement, the annular supports 50 provide the only supporting contact with the heater support sleeve 10 within the apparatus 1, which helps to minimize conductive heat losses. (It will be understood that there may be other components that connect with the heater support sleeve 10, but in general these do not provide mechanical support for the heater support sleeve 10 within the apparatus 1.) A particularly suitable material for the annular supports 50 is polyether ether ketone (PEEK), though other plastics, or other heat insulating materials, may be used.

Figure 11:
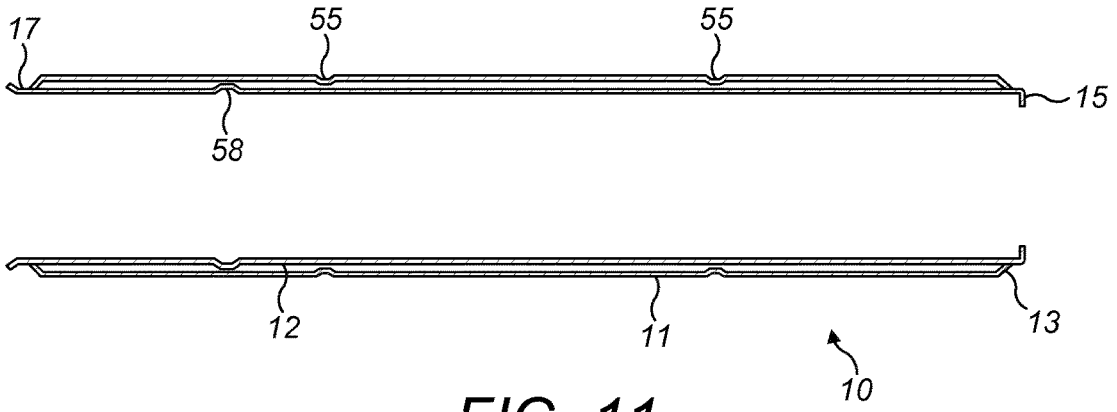
FIG. 11 shows a longitudinal cross-sectional view of another example of a heater support sleeve suitable for use in the apparatus of FIG. 1.

Referring to FIG. 11, another example of a heater support sleeve 10 is shown. This example of the heater support sleeve 10 has a number of features, one or more of which may be incorporated into the first example described above.

In the example of a heater support sleeve 10 shown in FIG. 11, at the location where one or more of the annular supports 50 contacts the heater support sleeve 10, an annular groove 55 may be provided in the outer wall 11 of the heater support sleeve 10. Alternatively or additionally, rather than a continuous annular groove, there may be plural indentations or recesses 55 extending around the circumference of the outer wall 11 of the heater support sleeve 10. These indentations or recesses 55 may be provided at points of contact between the annular supports 50 and the outer wall 11 of the heater support sleeve 10. For example, the or each annular groove 55 or individual recesses 55 may receive the tips of the plural inwardly facing contact projections 51 of the annular supports. The or each annular groove 55 or individual recesses 55 in the outer wall 11 of the heater support sleeve 10 assist in accurate location of the annular supports 50 and help to retain the annular supports 50 in the correct position. Such annular grooves 55 and/or indentations or recesses 55 may be provided in the first example of the heater support sleeve 10 described above.

In another example, shown in FIG. 11, there may be one or more annular grooves 58 within the inner wall 12 of the heater support sleeve 10. In combination with a retaining clip or other feature provided on or in conjunction with the heater segments 20, such recesses 58 to the inner wall 12 of the heater support sleeve 10 can assist in secure and stable retention of the heater assembly within the heater support sleeve 10. Such annular grooves 58 and/or indentations may be provided in the first example of the heater support sleeve 10 described above.

An opening 17 at one end of the heater support sleeve 10 may be flared. This enables easier entry into the heater support sleeve 10 of the components contained within it, including the heater segments 20 and the mechanical isolators 30, especially during manufacture for example. Such a flare 17 may be provided in the first example of the heater support sleeve 10 described above.

The outer housing 2 may be formed of a heat insulating material. A particularly suitable material is polyether ether ketone (PEEK), though again other plastics, including for example acrylonitrile butadiene styrene (ABS), or other heat insulating materials, may be used. The outermost surface of the outer housing 2 may have a decorative coating, such as a metallic finish. The innermost surface of the outer housing 2 may be coated, partially or fully, with a material that is a good heat conductor. A metal coating, such as of copper, which may for example be approximately 0.05 mm thick, may be used for this purpose. In the case that the heater support sleeve 10 is supported by annular supports 50 as discussed above, the outer housing 2 may in particular have a heat conductive coating 24 on its inner surface at least around the regions where the annular supports 50 contact the outer housing 2. This acts as a heat spreader to help dissipate any heat that has been conducted to the outer housing 2 from the heater support sleeve 10 by the annular supports 50, which helps to prevent hot spots building up on the outer housing 2.

The mechanical isolators 30 may all be identical. Alternatively, at least one of the rearmost and the frontmost mechanical isolator 30 may be differently formed at the rearmost/frontmost face respectively. An example of the frontmost mechanical isolator 30 being different is given above. The rearmost mechanical isolator 30 may be differently shaped at its rearmost face to accommodate or facilitate or provide for air flow inlet into the heating chamber 4. For example, referring to the example shown in FIG. 10, the rearmost face 37 of the rearmost mechanical isolator 30 may be formed as an end wall 37 with an air inlet orifice 38 that is centrally located in the end wall 37 of the rearmost mechanical isolator 30. The outer housing 2 in this example has at least one air inlet orifice 60 positioned close to the location of the air inlet orifice 38 of the rearmost mechanical isolator 30 to admit air into the apparatus 1 and then into the rearmost mechanical isolator 30.

Figure 12:
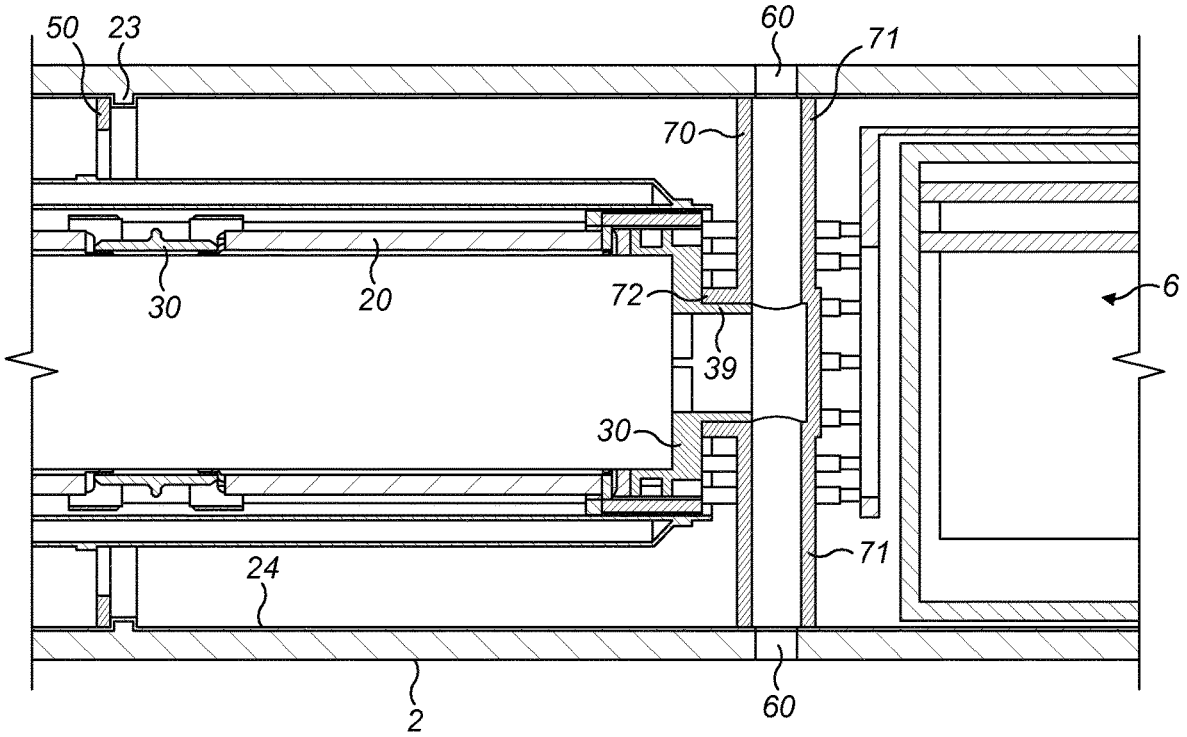
FIG. 12 shows a longitudinal cross-sectional view of an example of the rearmost portion of an apparatus for heating a smokable material.

In one example, the arrangement is such that air flowing into the apparatus 1 does not pass over the electronics/power chamber 6, and in particular does not pass over the electrical control circuitry 7 and power source 8. An example of how to achieve this is shown in FIG. 12. An air inlet pipe 70 connects the air inlet orifice 60 of the outer housing 2 to the air inlet orifice 38 of the rearmost mechanical isolator 30 so that air can only enter the apparatus 1 through the air inlet orifice 60 of the outer housing 2, through the air inlet pipe 70 and through the air inlet orifice 38 of the rearmost mechanical isolator 30 and thence into the heating chamber 4. The air inlet orifice 38 may be defined by a circular or similar shape wall 39 which projects rearwardly of the end wall 37 of the rearmost mechanical isolator 30 and which provides a connector mount for the air inlet pipe 70.

There may be plural air inlet orifices 60 in the outer housing 2, with the air inlet pipe 70 being appropriately arranged to convey the air to the rearmost mechanical isolator 30. In one arrangement, there are two air inlet orifices 60 in the outer housing 2, provided on opposed sides of the outer housing 2. The air inlet pipe 70 in such a case may have a generally T-shape or Y-shape cross-section, having first and second arms 71, which connect to the first and second outer housing air inlets 60 respectively, and a stem 72, which connects to the air inlet orifice 38 of the rearmost mechanical isolator 30 (optionally by mounting to the wall 39 that defines the air inlet orifice 38) to provide for air flow into the adjacent, rearmost heater segment 20.

Where provided, the air inlet pipe 60, of whatever form, may be formed integrally with the rearmost mechanical isolator 30. As an alternative, where provided, the air inlet pipe 60, of whatever form, may be formed integrally with the outer housing 2. It is more convenient however for the air inlet pipe 60, of whatever form, to be provided as a separate component. To facilitate assembly of the apparatus 1 during manufacture, and to provide a mount for the air inlet pipe 60, the air inlet orifice 38 of the rearmost mechanical isolator 30 may be provided by a rearwardly facing collar 39 which projects away from the rearmost face 37 of the rearmost mechanical isolator 30. The air inlet pipe 70 may attach to this collar 39 of the rearmost mechanical isolator 30. In the particular example where the air inlet pipe 70 has a generally T-shape or Y-shape cross-section discussed above, the stem 72 of the air inlet pipe 70 may be sized to fit snugly around the collar 39 of the rearmost mechanical isolator 30. In an alternative arrangement (not shown), the stem 72 of the air inlet pipe 70 may fit snugly within the collar 39 of the rearmost mechanical isolator 30.

In order to address various issues and advance the art, the entirety of this disclosure shows by way of illustration and example various embodiments in which that which is claimed may be practiced and which provide for a superior apparatus arranged to heat smokable material but not burn the smokable material. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An apparatus arranged to heat smokable material to volatilize at least one component of the smokable material for inhalation by a user of the apparatus, the apparatus comprising:

a housing;

a plurality of heater segments longitudinally arranged within the housing for heating smokable material contained within the apparatus; and control circuitry configured to control a supply of electrical power selectively and independently to each one of the plurality of heater segments;

wherein a first one of the plurality of heater segments is arranged so as to heat a first portion of the smokable material contained within the first one of the plurality of heater segments, and a second one of the plurality of heater segments is arranged to heat a second portion of the smokable material contained within the second one of the plurality of heater segments, and wherein the first one of the plurality of heater segments has a lower heat capacity than the second one of the plurality of heater segments;

wherein, when the first one of the plurality of heater segments and the second one of the plurality of heater segments are heated by the supply of electrical power to the plurality of heater segments, the first one of the plurality of heater segments heats more quickly than the second one of the plurality of heater segments.

2. The apparatus according to claim 1, wherein the first one of the plurality of heater segments defines a smaller volume than the second one of the plurality of heater segments.

3. The apparatus according to claim 2, wherein the first one of the plurality of heater segments is shorter than the second one of the plurality of heater segments in the longitudinal direction of the housing.

4. The apparatus according to claim 1, wherein the plurality of heater segments are hollow cylinders for containing smokable material to be heated therein.

5. The apparatus according to claim 1, wherein:

the housing is an outer housing;

a heater support sleeve is contained within the outer housing, the heater support sleeve defining at least two ends;

at least one of the plurality of heater segments is arranged within the heater support sleeve for heating smokable material contained within the apparatus; and a plurality of annular supports which support the heater support sleeve is arranged within the outer housing, with the heater support sleeve being mounted within the annular supports and the annular supports being mounted within the outer housing.

6. The apparatus according to claim 5, wherein each of the annular supports has plural inwardly facing contact projections which make contact with the heater support sleeve.

7. The apparatus according to claim 5, wherein an outwardly facing surface of the heater support sleeve has at least one of an annular groove and at least one recess which receives a portion of one of the plurality of annular supports to locate the one of the plurality of annular supports on the heater support sleeve.

8. The apparatus according to claim 5, wherein the annular supports are located away from the ends of the heater support sleeve.

9. The apparatus according to claim 5, wherein the annular supports are positioned equidistantly along the total length of the heater support sleeve.

10. The apparatus according to claim 5, wherein one of the plurality of annular supports is positioned ⅓ of the total length of the heater support sleeve away from a first end of the heater support sleeve, and another one of the plurality of annular supports is positioned ⅓ of the total length of the heater support sleeve away from a second end of the heater support sleeve.

11. The apparatus according to claim 5, wherein the heater support sleeve is a double-walled vacuum sleeve.

12. The apparatus according to claim 5, wherein the internal face of the housing being provided with at least a partial coating of heat conductor having a heat conductivity greater than a heat conductivity of the housing to conduct heat away from positions where the annular supports contact the internal face of the housing.

13. The apparatus according to claim 5, wherein the outer housing has at least one air inlet and the heater segment has at least one air inlet, and comprising an air inlet pipe providing fluid communication from the outer housing air inlet to the heater segment air inlet, the arrangement being such that air can be drawn in through the outer housing air inlet, through the air inlet pipe, through the heater segment air inlet and over smokable material contained within the apparatus.

14. The apparatus according to claim 13, constructed and arranged such that the at least one air inlet of the outer housing is the only entry point for air to be drawn into the apparatus in use.

15. The apparatus according to claim 13, wherein the control circuitry is contained within the outer housing for controlling the supply of electrical power to the at least one heater segment, the arrangement being such that air drawn in through the outer housing air inlet does not pass over the control circuitry.

16. The apparatus according to claim 13, wherein the outer housing has a first air inlet and a second air inlet on opposed sides of the outer housing, the air inlet pipe having a T-shape or Y-shape cross-section providing a first arm and a second arm which connect to the first outer housing air inlet and the second outer housing air inlet, respectively, and a stem which is in fluid communication with the heater segment air inlet.

17. The apparatus according to claim 1, wherein:

the housing is an outer housing, the outer housing having at least one air inlet;

at least one of the plurality of heater segments is contained within the outer housing for heating smokable material contained within the apparatus, the at least one heater segment having at least one air inlet; and an air inlet pipe provides fluid communication from the at least one outer housing air inlet to the at least one heater segment air inlet, such that air can be drawn in through the outer housing air inlet, through the air inlet pipe, through the heater segment air inlet and over smokable material contained within the apparatus.

18. The apparatus according to claim 17, constructed and arranged such that the at least one outer housing air inlet is the only entry point for air to be drawn into the apparatus in use.

19. The apparatus according to claim 17, comprising control circuitry contained within the outer housing for controlling the supply of electrical power to the at least one heater segment, the arrangement being such that air drawn in through the outer housing air inlet does not pass over the control circuitry.

20. The apparatus according to claim 17, wherein the outer housing has a first air inlet and a second air inlet on opposed sides of the outer housing, the air inlet pipe having a T-shape or Y-shape cross-section providing a first arm and a second arm which connect to the first outer housing air inlet and the second outer housing air inlet, respectively, and a stem which is in fluid communication with the heater segment air inlet.

* * * * *